US007073942B2

(12) United States Patent
Vazquez

(10) Patent No.: US 7,073,942 B2
(45) Date of Patent: Jul. 11, 2006

(54) VERTICALLY EXPANDABLE BAG

(75) Inventor: Maximino Vazquez, New York, NY (US)

(73) Assignee: Maxworld, Inc., New York, NY (US)

( * ) Notice: Subject to any disclaimer, the term of this patent is extended or adjusted under 35 U.S.C. 154(b) by 47 days.

(21) Appl. No.: 10/424,469

(22) Filed: Apr. 28, 2003

(65) Prior Publication Data

US 2003/0185465 A1 Oct. 2, 2003

Related U.S. Application Data

(60) Continuation-in-part of application No. 29/169,217, filed on Oct. 16, 2002, now Pat. No. Des. 482,197, which is a continuation-in-part of application No. 09/782,627, filed on Feb. 13, 2001, now abandoned, which is a division of application No. 29/137,117, filed on Feb. 13, 2001, now Pat. No. Des. 473,374, which is a continuation-in-part of application No. 29/106,466, filed on Jun. 15, 1999, now Pat. No. Des. 437,481, which is a continuation-in-part of application No. 29/094,412, filed on Oct. 1, 1998, now abandoned.

(51) Int. Cl.
*B65D 33/00* (2006.01)

(52) U.S. Cl. ..... 383/2; 383/18; 190/103

(58) Field of Classification Search ..... 383/2, 383/18, 75; 190/103
See application file for complete search history.

(56) References Cited

U.S. PATENT DOCUMENTS

| | | | | | |
|---|---|---|---|---|---|
| 456,397 | A | * | 7/1891 | Brooks | 383/2 |
| 811,215 | A | * | 1/1906 | Goldsmith | 150/108 |
| 1,335,607 | A | * | 3/1920 | Salisbury | 338/18 |
| 1,583,083 | A | * | 5/1926 | Macaraig | 220/9.2 |
| 1,729,318 | A | * | 9/1929 | Wunderlich | 383/2 |
| 1,902,368 | A | * | 3/1933 | Johns | 383/4 |
| 2,447,561 | A | * | 8/1948 | Brenner | 2/174 |
| 3,746,066 | A | * | 7/1973 | McIntyre | 150/107 |
| 4,248,366 | A | * | 2/1981 | Christiansen | 224/148.6 |
| 4,890,413 | A | * | 1/1990 | Nelson et al. | 43/55 |
| 5,018,830 | A | * | 5/1991 | Krop | 5/413 R |
| 5,050,924 | A | * | 9/1991 | Hansen | 296/100.15 |
| 5,082,171 | A | * | 1/1992 | Homel et al. | 232/43.2 |
| 5,454,497 | A | * | 10/1995 | Kettelson | 224/148.6 |

* cited by examiner

*Primary Examiner*—Jes F. Pascua
(74) *Attorney, Agent, or Firm*—Darby & Darby

(57) ABSTRACT

The invention relates to a bag that includes a shell having a predetermined maximum vertical rise. A channel is connected to the shell. An elongated strap has a first portion and a second portion. The first portion is disposed within the channel, and the second portion is exposed from the channel. The strap is moveable with respect to the channel thereby causing the shell to cinch and the bag to assume a vertically constrained size while a carry strap increases in size. Optionally, the carry strap has an adjustable length to meet the needs of users of various height and having differing notions of how to wear the bag on their bodies.

17 Claims, 10 Drawing Sheets

VERTICALLY EXPANDABLE BAG

CROSS REFERENCE TO RELATED CASES

This is a continuation-in-part of U.S. application Ser. No. 09/782,627, filed Feb. 13, 2001, now abandoned, which is a continuation-in-part of Design Application No. 29/106,466, filed Jun. 15, 1999, entitled "Bag With Variable Gathers," now issued as U.S. Pat. No. D437,481, which is a continuation in part of Design Application No. 29/094,412, filed Oct. 1, 1998, entitled "Scrunch Bag," now abandoned. This application is also a continuation-in-part of U.S. application Ser. No. 29/169,217, filed Oct. 16, 2002 entitled "Variable Volume Tubular Bag," now U.S. Pat. No. D482,197, which is a division of U.S. application Ser. No. 29/137,117, filed Feb. 13, 2001, entitled "Tubular Bag With Variable Gathers," now U.S. Pat. No. D473,374, which is also a continuation-in-part of the aforesaid 29/106,466 application, now U.S. Pat. No. D437,481. Each of the foregoing applications is hereby incorporated by reference as if set forth in their respective entireties herein.

BACKGROUND OF THE INVENTION

1. Field of the Invention

The present invention relates to a bag whose vertical dimension can readily change while the bag is in use to accommodate a great many different height users as well as the carry needs of such users.

2. Discussion of the Related Art

Various bags in accordance with the prior art are illustrated in FIGS. 1–4. For example, FIG. 1 illustrates a conventional backpack in which cinching is done by varying a length of webbing 106 through a system of sliders. 108. The webbing 106 is on the exterior of the backpack and the ends are sewn into the panel seams 109. Also cinching of the backpack can be accomplished by draw cords 110 on the exterior of the backpack that are channeled through fabric strips 111 folded over onto themselves and stitched into the panel seams 109. The draw cords are held in place by a cord lock 112.

FIG. 2 illustrates a conventional drawstring pouch 102 which is closed by pulling a draw cord 110 through a neck 113 of the pouch. The neck 113 of this pouch comprises an upper edge of the fabric of the pouch folded over onto itself and stitched to thereby define a tunnel for the draw cord 110 to pass through. The draw cord is cinched by a cord lock 112, but the vertical rise of the pouch is not effected.

FIG. 3 illustrates a conventional tote 104 having a handle 116 affixed to the top for carrying by a user. The tote includes a zipper 120 that is arranged to release a gusset 118 that circumscribes the width of the tote. Typically, the tote is put down and then unzipped to expose a panel of material that will lengthen the exterior. When released, as shown in FIG. 4, the length of the bag is increased by the size of the gusset 118, while the relationship of the handle 116 to the tote 104 remains unchanged. To shorten the bag once again, the zipper puller must be manually aligned with the zipper teeth.

Common to the designs of FIGS. 1–4 is a mechanism for adjusting the volume or access to the bags in a specific way; however, bag designers have not been attentive to the vertical component of carry bags, which is a critical component if the needs of a range of users is to be accommodated. It has been posited that ninety percent of the adult human female population is within eight inches of a median height, yet the sixteen inch variation among such persons is quite difficult to accommodate with a universal bag. Because of different human heights in the target audience, the vertical length of a bag has been a determining factor in selecting a bag to purchase, use, and also in governing how a user can carry the bag (when considered in combination with the carry strap).

What is needed in the art are improvements in bags that readily accommodate, among other things, differences in body heights and differences in preferred carry methods while the bag is in use. The present invention addresses these and other needs in the art.

SUMMARY OF THE INVENTION

In one aspect, the present invention relates to a vertically expandable bag which includes a shell having a lower margin and an upper margin spaced from the lower margin by a predetermined vertical rise of material. The shell defines an interior space for receiving items. A channel is defined along the predetermined vertical rise of material of the shell. There is an elongated strap having a first portion disposed within the channel and a second portion exposed from the channel and defining a carry strap for handling by a user. The channel cinches the material of the shell along the predetermined vertical rise thereof as the upper margin is slid along the first portion of the strap toward the lower margin of the shell while the second portion of the strap defining the carry strap increases in length. Any gathers in the shell are released and the predetermined vertical rise is at least partially restored as the upper margin is slid along the second portion of the elongated strap.

In the invention, a cinching mechanism is combined with a carry handle to provide a universally adaptable bag for an expanded number of uses and persons as compared to prior art constructions.

These and other advantages and features of the invention will be apparent from the accompanying drawing figures and description of certain embodiments thereof.

DESCRIPTION OF THE DRAWING FIGURES

FIG. 9A illustrates a variation of the bag of FIG. 9 in which a loop adjustment mechanism is configured to have no free end.

DETAILED DESCRIPTION OF THE PRESENTLY PREFERRED EXEMPLARY EMBODIMENTS

As usual herein, "cinching" refers to the act of gathering material and is used to describe a shortening of the maximum length of a fabric panel. Gathers are the folds of fabric. The strap "cinches" the fabric by gathering it into a shorter length.

Figure 1:
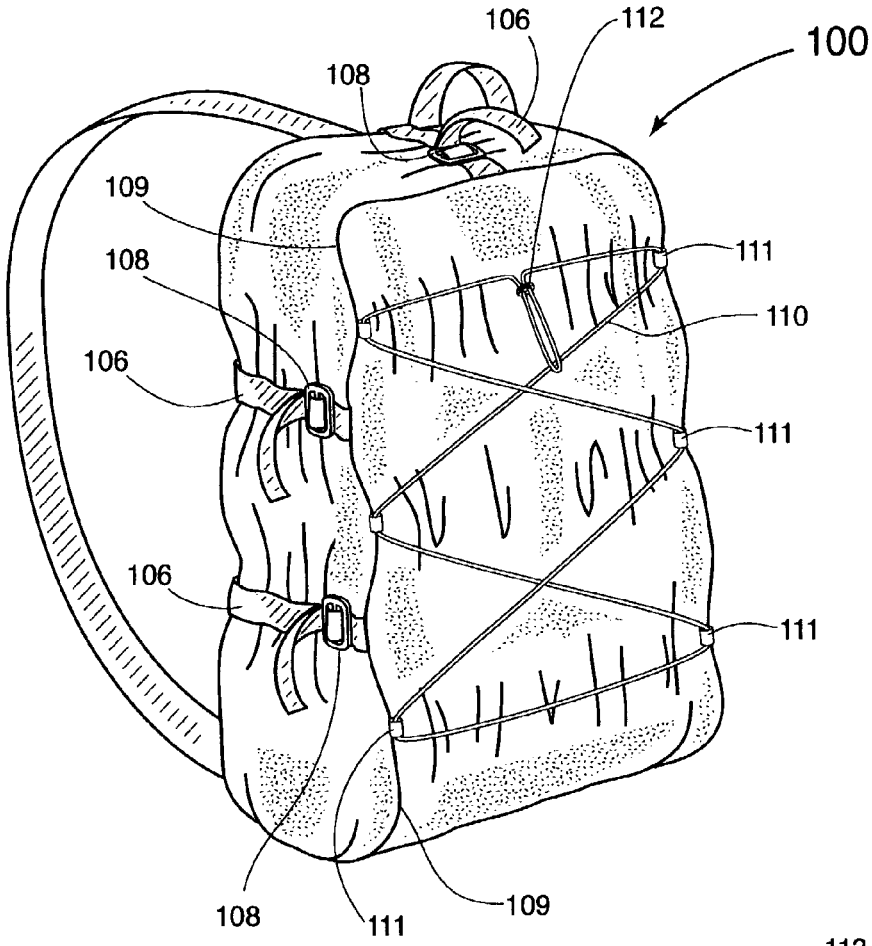
FIG.1 PRIOR ART
FIG. 1 is a perspective view of a backpack in accordance with the prior art.
Figure 2:
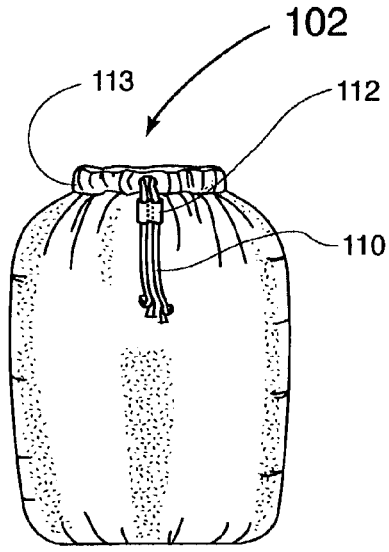
FIG.2 PRIOR ART
FIG. 2 is a front plan view of a pouch in accordance with the prior art.
Figure 3:
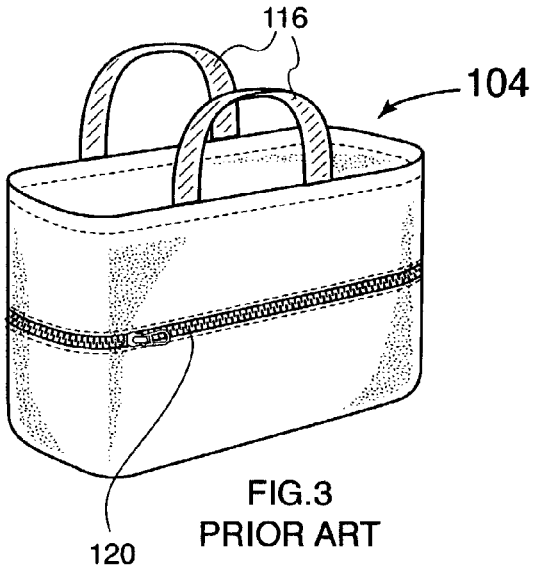
FIG.3 PRIOR ART
FIGS. 3 and 4 are perspective views of a tote in accordance with the prior art.
Figure 4:
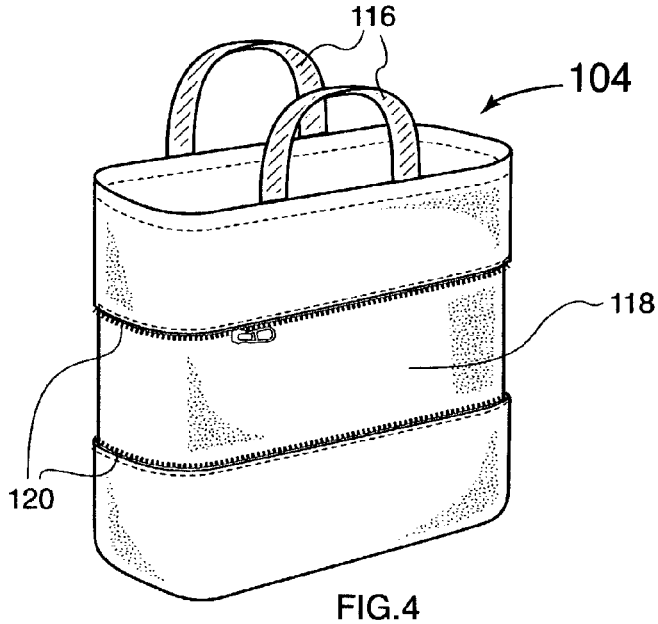
FIG.4 PRIOR ART
Figure 5:
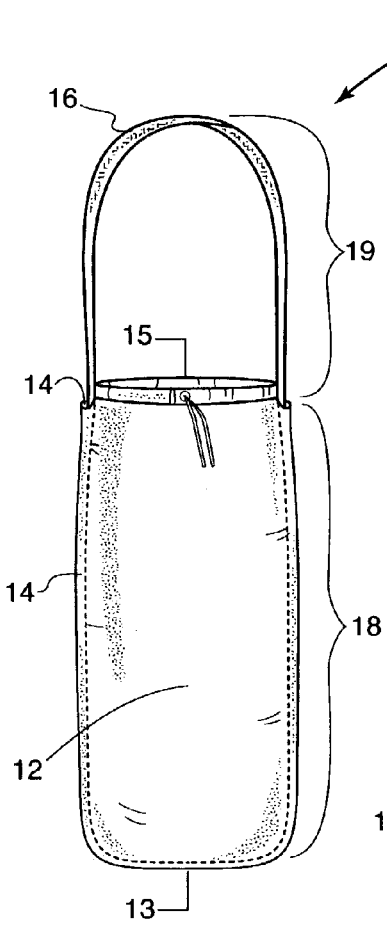
FIGS. 5–7 are a front plan view of a bag in accordance with the present invention shown with a top margin disposed at different positions along a carry strap.
Figure 6:
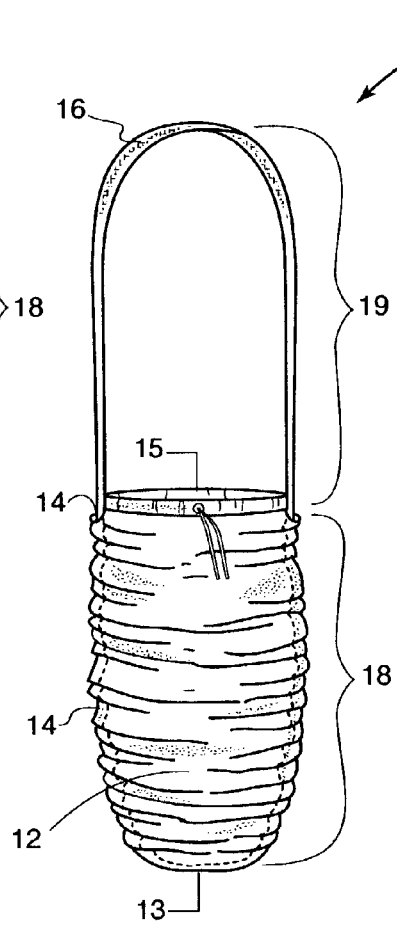
Figure 7:
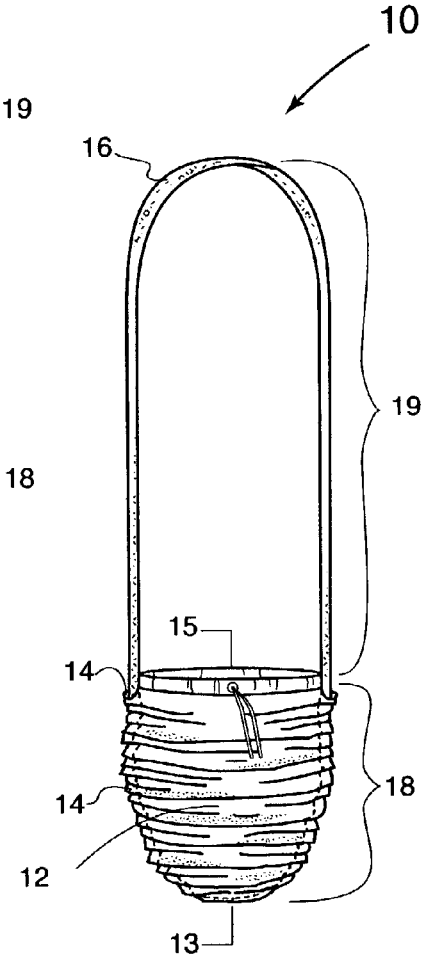

Referring now to FIGS. 5–7, a bag 10 in accordance with the present invention is illustrated. Bag 10 includes a shell 12 having a predetermined maximum volume as illustrated in FIG. 5. The shell comprises a panel of material stitched so as to define a predetermined vertical rise between a lower margin 13 and an upper margin 15. The shell also defines an interior space for receiving items. A channel 14 is defined along the vertical rise of the bag 10 by at least one stitch line sewn into the outside of shell 12. An elongated strap 16 has a first portion 18 and a second portion 19. The first portion 18 is disposed within channel 14, and is therefore hidden from view in the Figures. Second portion 19 is exposed from channel 14. Part of the exposed portion 19 forms a handle or carry strap for handling by a user.

The size of bag 10 can be changed by moving strap 16 with respect to channel 14, thereby causing the volume of bag 10 to vary from a maximum volume (see FIG. 5) to volumes less than the maximum volume (see FIGS. 6 and 7) to readily accommodate different contents placed within the bag while in use. In addition, the vertical rise of the bag can be changed by cinching the shell 12 along the length of the elongated strap 16. More particularly, the upper margin 15 can be positioned relative to the strap 16 so as to cinch the material of the shell about the first portion 18 of the strap 16 and thereby shorten the vertical rise of the bag. In other words, as the upper margin 15 is slid along the first portion 18 of the elongated strap toward the lower margin of the shell 12. Concomitantly, the second portion 19, which defines the handle or carry strap, increases in length at a rate related to the shortening of the first portion (e.g., the same rate). Any gathers in the shell are released and the predetermined vertical rise is at least partially restored as the upper margin is slid along the second portion of the elongated strap.

Figure 5A:
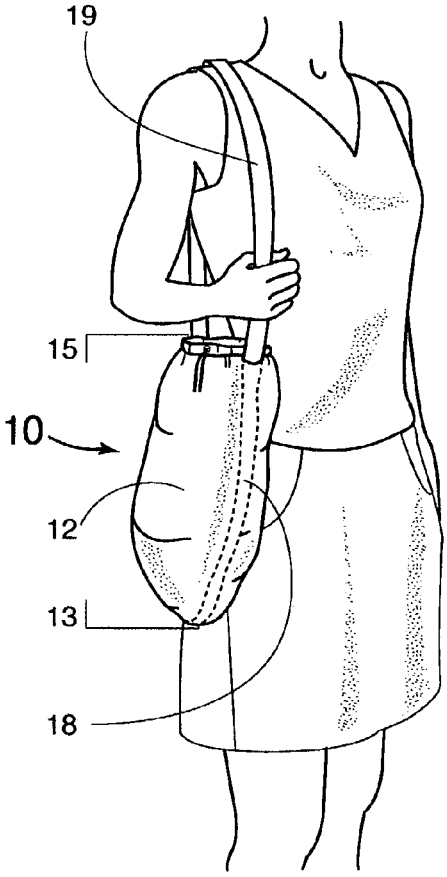
FIG. 5A is the bag of FIG. 5 shown on a model.

Referring to FIG. 5A, the bag 10 of FIG. 5 is shown on the right side of a model, with the bag supported from the model's right shoulder. As in FIG. 5, the shell 12 of the bag is essentially uncinched so that the upper margin is spaced from the lower margin by the predetermined vertical rise of the material of the shell. For this model, the uncinched shell places the upper margin 15 just above her hip, a preferred placement for many people.

Figure 6A:
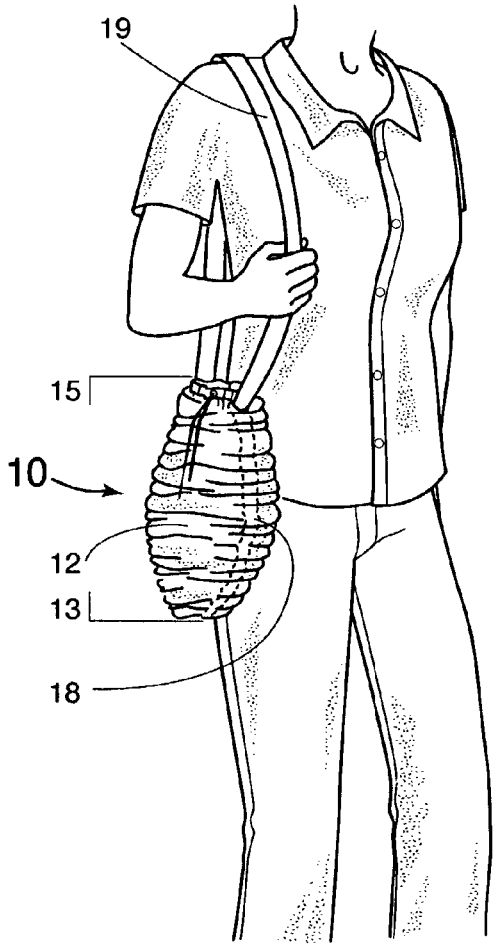
FIG. 6A is the bag of FIG. 6 shown on a model having a longer torso than the model of FIG. 5A.

In FIG. 6A, the bag of FIG. 6 is shown on the right side of a model, suspended from the model's right shoulder, just as in FIG. 5A. The model in FIG. 6A has a comparatively longer torso than the model of FIG. 5A, yet the bag 10 can still be arranged to have the upper margin 15 just above the hip by cinching the shell 12 so as to expose more of the elongated strap and increase the amount of the section portion 19 that defines the carry strap. (Thus, enabling both body lengths to carry the same bag at the hip placement.)

Figure 8:
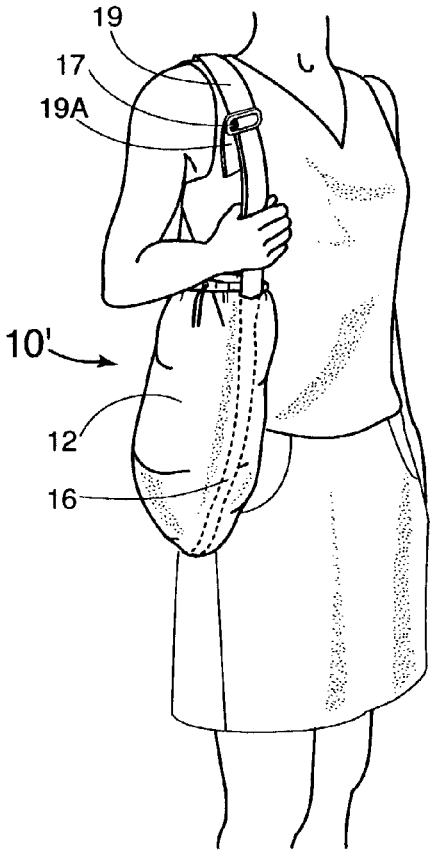
FIGS. 8–10 are a variation of the bag of FIGS. 5–7, now showing an adjustable strap loop length.
Figure 10:
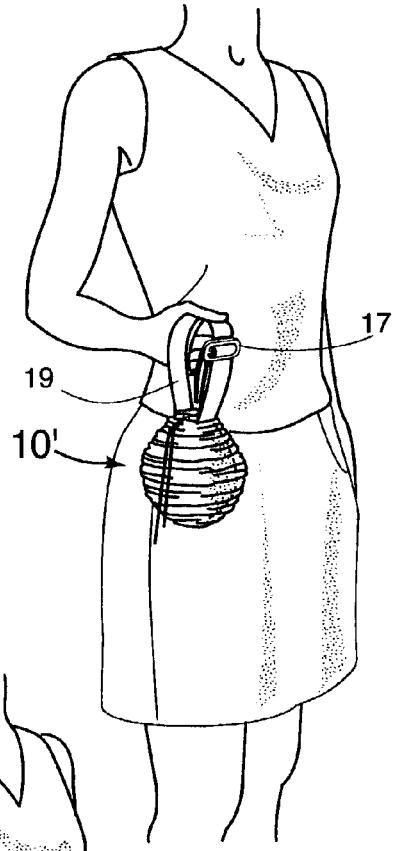
Figure 9:
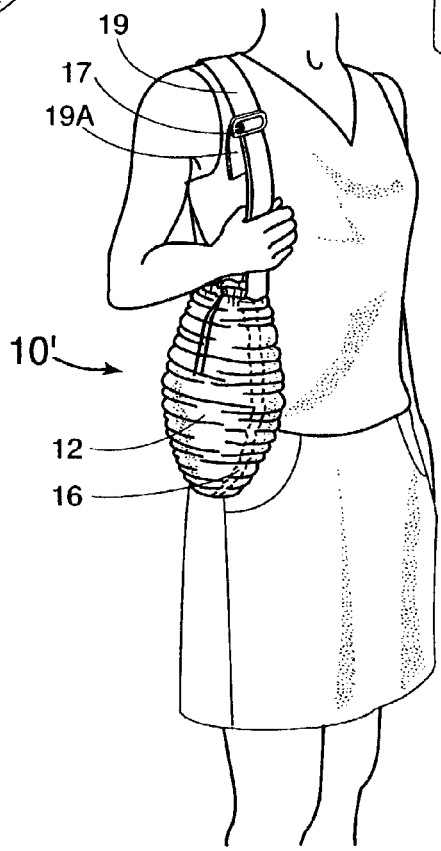

Referring now to FIGS. 8–10, bag 10' is illustrated in various shapes and volumes depending upon the contents within the bag and the user's handling preferences and/or requirements. Bag 10' utilizes the elongated strap 16 as a part of the channel/cinching mechanism and also as the carry strap 19. Optionally, the elongated strap can extend around the bottom of the bag to support the contents of the bag. The carry strap 19 includes a mechanism 17 that permits the loop length of the elongated strap 16 to be adjusted.

As illustrated, the mechanism 17 can be a slider such as the D-ring slider illustrated in FIGS. 8–10. Alternatively, the loop length can be adjusted by different mechanisms including separable ends each fitted with complementary hook and loop fasteners or snaps. As another alternative to using sliders, the carry strap can comprise a belt and buckle a series of holes in the belt for receiving the buckle. In this configuration, the belt serves as the carry strap and any excess belt portion passes through the buckle and remains loose (unattached). The use of sliders is preferred, however, because the carry strap can be adjusted to an infinite number of lengths. The loop length adjustment permits the same person (as illustrated in FIGS. 8–10) to selectively cinch the bag 10' to different degrees (thereby shortening the vertical rise of the bag) while using the mechanism 17 to take up slack in the second portion 19. Consequently, a person can shorten the vertical rise of the bag 10' to suit that person's needs yet wear the bag at the same location on her body. As well, the bag 10' can be shortened and the mechanism 17 adjusted to shorten the carry strap 19 so that the bag can be carried in the hand like a purse. All of these carry methods can be easily accomplished while the bag is in use and secured to the user. As a result of the adjustment, a free end 19A lengthens as the loop is shortened, and vice versa.

In FIG. 9A, a variation of the bag 10' of FIG. 9 is illustrated in which the bag 10" has first and second mechanisms 17A, 17B arranged relative to the elongate strap 16 so that there is no longer a free end 19A on the carry strap 19. Instead, one end of the elongate strap is anchored to the mechanism 17A while an intermediate 16A portion of the elongate strap 16 passes through mechanism 17B and then through mechanism 17A and back to an anchor point at mechanism 17B. This arrangement has the elongated strap 16 passing through the channel 14 and around the bottom of the bag. Alternatively, however, the elongated straps 16' can be provided, one in each channel 14, with the strap 16' secured to the shell 12 generally near or at the bottom margin 13 of the bag 10".

Figure 11:
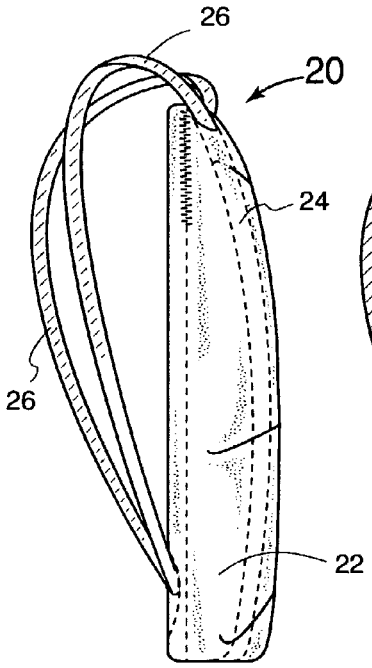
FIGS. 11–13 are side views of another embodiment in accordance with the invention, shown at different vertical rises.
Figure 12:
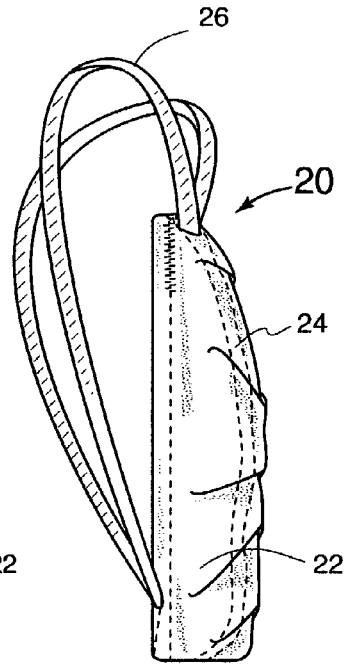
Figure 13:
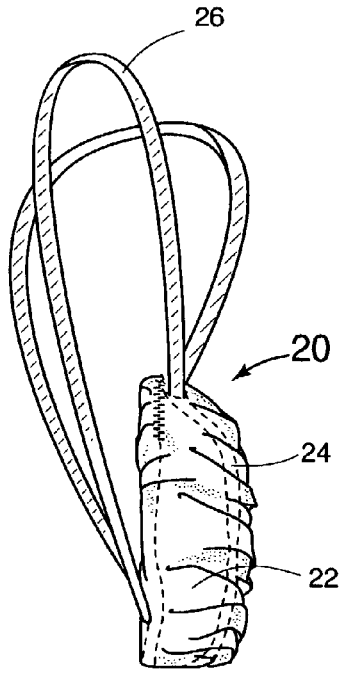

Other types of bags in accordance with the present invention may incorporate a similar type of strap/channel gathering system as shown in FIGS. 5–10. For example, referring now to FIGS. 11–13, a knapsack 20 is illustrated. Knapsack 20 has a shell 22 and a pair of channels 24 sewn into the outside of shell 22. A strap 26 has a portion extending through channel 24. As with bag 10, strap 26 is moveable with respect to channel 24 causing a predetermined vertical rise of the shell to vary from a maximum length (see FIG. 11) to any number of a plurality of shorter, cinched lengths which are less than the maximum length (see, e.g., FIGS. 12 and 13).

Figure 14:
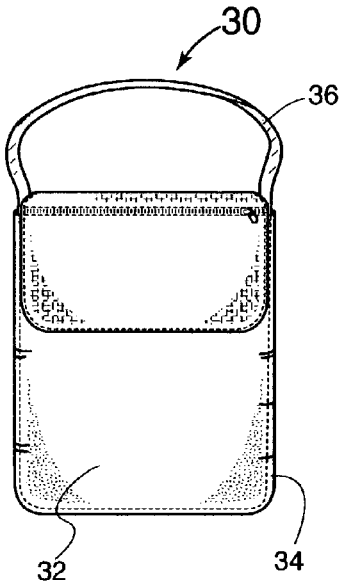
FIGS. 14–16 are front views of a third embodiment of a bag in accordance with the invention that uses the strap/channel gathering system of FIGS. 5–13.
Figure 15:
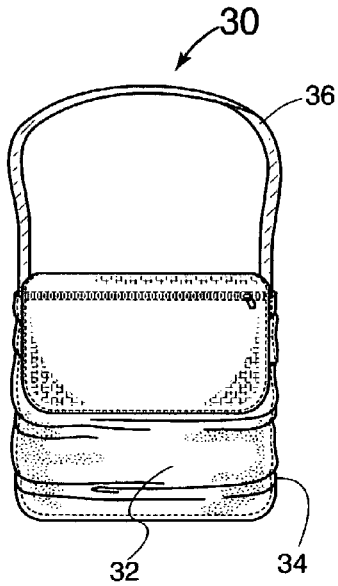
Figure 16:
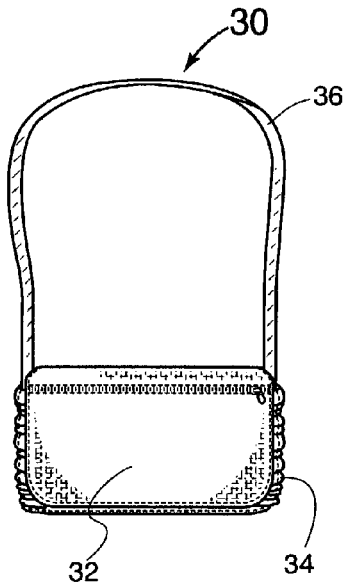
Figure 16A:
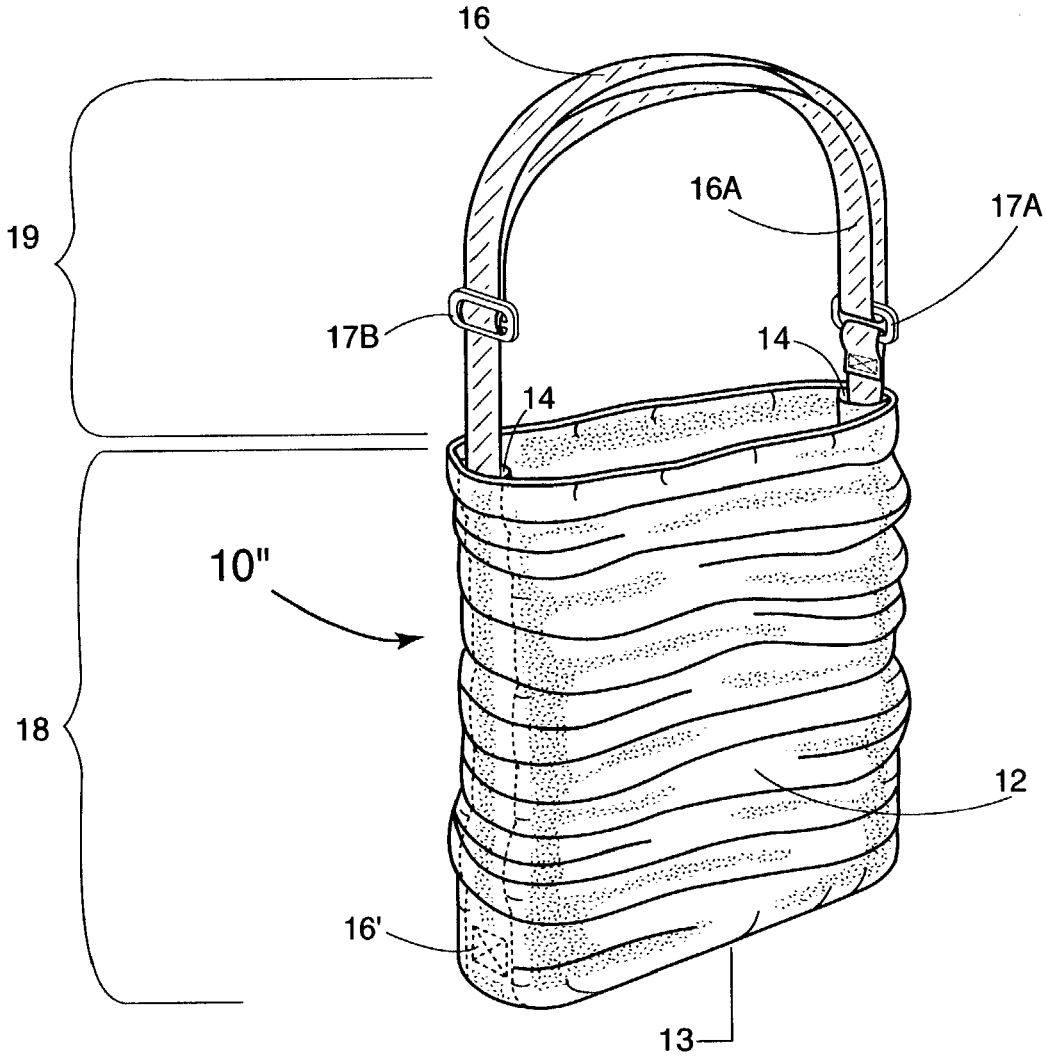

Referring now to FIGS. 14–16, a messenger bag 30 is illustrated using the same strap/channel gathering system of FIGS. 5–13.

Figure 17:
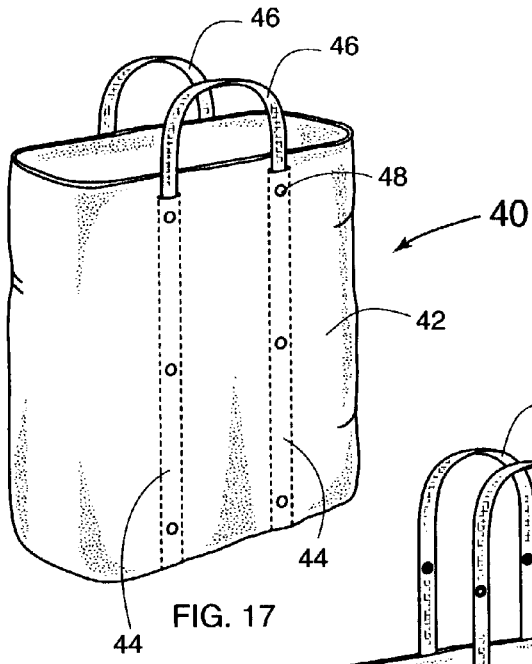
FIGS. 17–19 are perspective views of a bag in accordance with the invention having optional, mating snaps that secure the bag in one or more cinched configurations.
Figure 18:
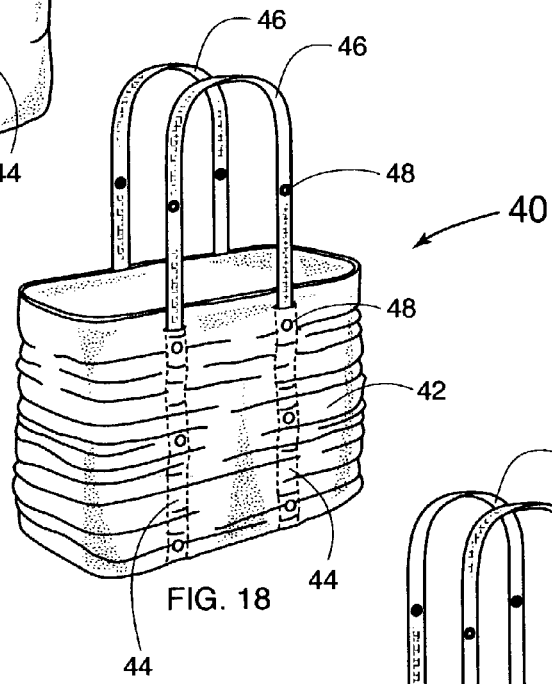
Figure 19:
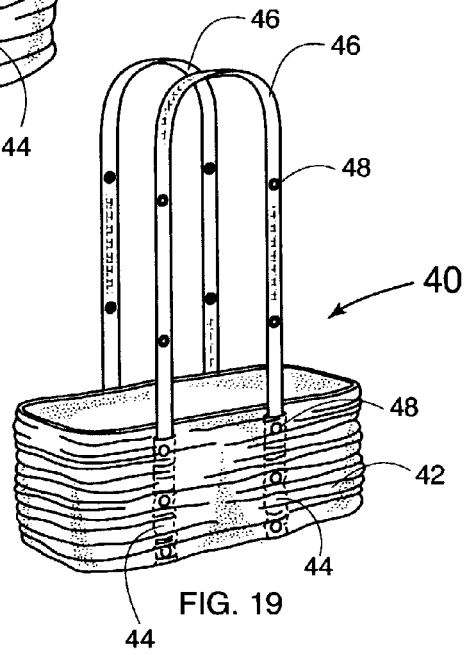

Referring now to FIGS. 17–19, a tote bag 40 using a channeling technique is illustrated. Bag 40 includes a shell 42 and a plurality of channels 44 each comprising at least one stitch line in the material of the shell 42. Four strap segments 46 (two of which are hidden from view, and are therefore not shown) are placed within the channels 44. As illustrated in FIGS. 17–19, each strap segment 46 has one mating portion of a snap 48 connected to it. These snaps are preferably low-profile snaps so that each snap can easily travel through channel 44. However, those skilled in the art will readily recognize that the snaps could be of conventional size and the channel would have to be sized accordingly so that the snap can travel there through. Complementary, mating portions of the snap are connected to channel 44 at predetermined spaced apart locations so that the strap can be secured in place with respect to the channel in any of a number of positions as illustrated in FIGS. 17–19. These low-profile snaps are sold under the trade name FASGRIP®, which are commercially available from Fasnap of Elkhart, Ind. The use of snaps permits the vertical rise of the bag 40 to be adjusted and then secured into position.

Figure 18A:
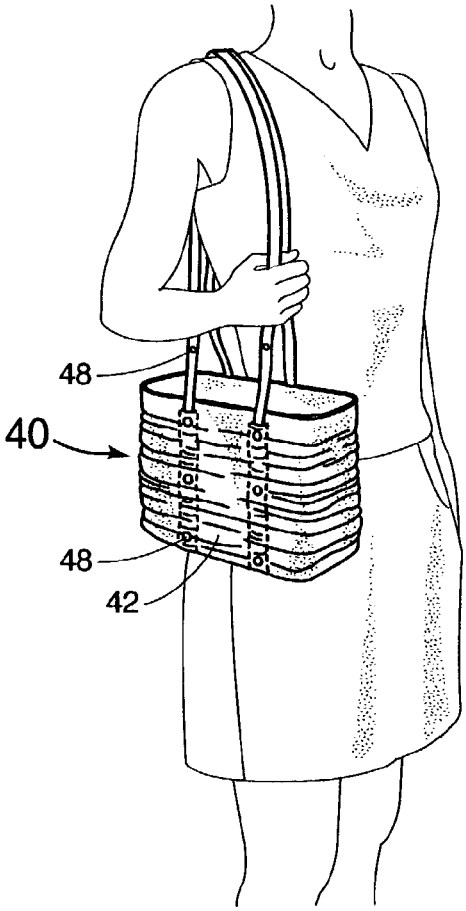
FIG. 18A is a perspective view of a user carrying the bag of FIG. 18 with the snaps mated together.
Figure 18B:
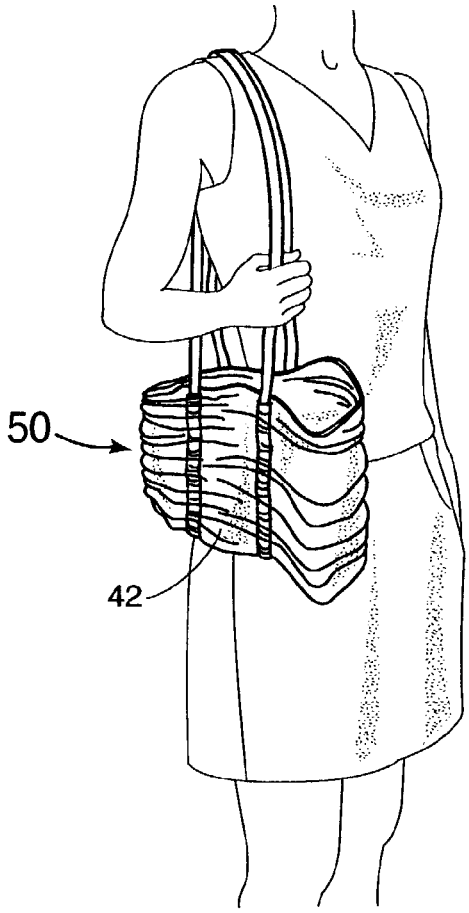
FIG. 18B is a perspective view of a user carrying the bag of FIG. 18 with the snaps unattached.
Figure 22:
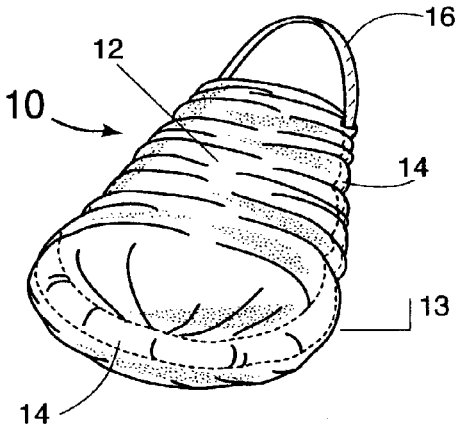

In FIG. 18A, the snaps 48 have been engaged to provide a "neater" appearance than in FIG. 18B because the engaged snaps ensure equidistant spacing along the length of the shell 42 of the bag. In FIG. 18B, FIGS. 22 and 23, a bag 50, similar to the bag shown in Figure bag 40 has the snaps disengaged.

For ease of illustration in the drawings, all channels have been shown on the exterior of the bag. However, one skilled in the art will readily recognize that the channels can also be sewn on the inside of the bag so that the cord loops or strap loops are disposed in the interior of the bag or there can be a folded over and stitched edge at the side seam of the bag. It is currently preferred to place the channels on the inside of the bags so that the bags will have a less messy appearance and the straps or cord loops will not likely entangle with exterior objects. The channels themselves can be formed by stitching a row between the lining and the face of the bag, thereby creating a channel for the cinching material (e.g., cord or webbing). Alternatively, the loops can be exposed on one side of the single-ply fabric through the use of a slit or an eyelet placed between the stitched channels on the same side of a single-ply fabric.

Figure 20:
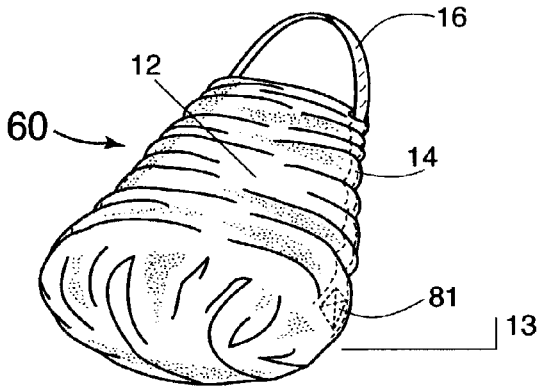
FIGS. 20–22 illustrate various arrangements of the elongated strap from a bottom perspective view.
Figure 21:
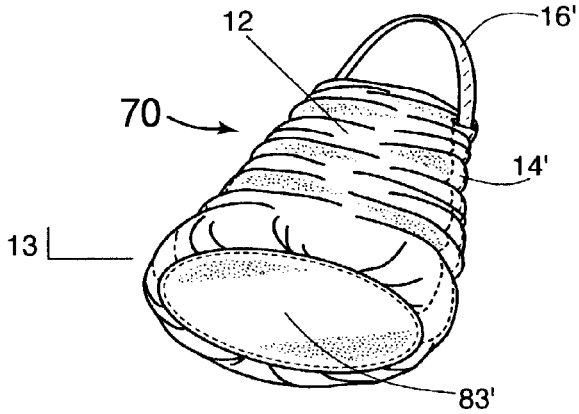

Referring now to FIGS. 20–22, the elongated strap 16 has a first portion disposed within the channel 14, as previously noted, but now is shown from a bottom perspective in order to illustrate alternative arrangements of the elongated strap 16. Thus, in FIG. 20, the strap 16 is stitched at the side of the bag 60, proximate the lower margin by a box stitch 81 which secures the strap immovably to the shell 12. FIG. 21 illustrates strap 16' and channel 14' terminating at a base panel 83' that is stitched in place at the bottom margin 13 of the bag 70. FIG. 22 has the strap 16 freely movable within the channel 14 about the bottom margin 13 of the bag of the bag 10.

Having described the presently preferred exemplary embodiment of a bag with variable volume in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A vertically expandable bag suitable for carrying on a shoulder of a user, comprising:

a shell having a lower margin and an upper margin spaced from the lower margin by a predetermined vertical rise of material, the shell defining an interior space for receiving items; and means for cinching the material of the shell along the predetermined vertical rise thereof, the cinching means consisting of:

an enclosed elongate channel defined along the predetermined vertical rise of material of the shell, and an elongated strap having a length which includes a first portion slidably disposed within the channel and sized so as to permit gathering of the material of the shell about the first portion and a second portion exposed from the channel and defining a shoulder carry strap for handling by the a user, the second portion increasing in length at the same rate that the first portion within the channel is shortened, wherein the cinching means operates so as to permit release of any gathers in the shell and at least partial restoration of the predetermined vertical rise as the upper margin is slid along the second portion of the elongated strap; and wherein the shell has an edge folded over onto itself and wherein the channel is formed by a row of stitches inside the folded over edge.

2. The bag of claim 1, wherein the strap is immovably secured relative to the shell at a location more proximate to the lower margin than the upper margin.

3. The bag of claim 2, wherein the first portion of the strap is secured to the shell.

4. The bag of claim 3, further comprising a bottom panel proximate the lower margin of the shell and wherein the first portion of the strap is secured to the bottom panel.

5. The bag of claim 1, wherein the upper margin of the shell and the second portion of the elongated strap define a loop length and wherein the second portion includes at least one means for shortening the loop length.

6. The bag according to claim 1, wherein said channel is formed on the exterior of said shell.

7. The bag according to claim 1, wherein said channel is formed on the interior of said shell.

8. The bag according to claim 1, wherein said shell is formed of two plies of material.

9. A vertically expandable bag, comprising:

a shell having a lower margin and an upper margin spaced from the lower margin by a predetermined vertical rise of material, the shell defining an interior space for receiving items;

a channel defined along the predetermined vertical rise of material of the shell; and an elongated strap having a first portion disposed within the channel and a second portion exposed from the channel and defining a carry strap for handling by a user;

wherein the channel cinches the material of the shell along the predetermined vertical rise thereof as the upper margin is slid along the first portion of the strap toward the lower margin of the shell while the second portion of the strap defining the carry strap increases in length, wherein gathers in the shell are released and the predetermined vertical rise is at least partially restored as the upper margin is slid along the second portion of the elongated strap, wherein the shell has a side seam and wherein the channel is formed by a series of fabric loops inserted into the side seam.

10. A vertically expandable bag, comprising:

a shell having a lower margin and an upper margin spaced from the lower margin by a predetermined vertical rise of material, the shell defining an interior space for receiving items;

a channel defined along the predetermined vertical rise of material of the shell;

an elongated strap having a first portion disposed within the channel and a second portion exposed from the channel and defining a carry strap for handling by a user; and a snap having one mating half mounted on said strap and another mating half mounted in said channel, wherein the channel cinches the material of the shell along the predetermined vertical rise thereof as the upper margin is slid along the first portion of the strap toward the lower margin of the shell while the second portion of the strap defining the carry strap increases in length, and wherein gathers in the shell are released and the predetermined vertical rise is at least partially restored as the upper margin is slid along the second portion of the elongated strap.

11. The bag of claim 10, wherein first portion of the strap is immovably secured relative to the shell at a location more proximate to the lower margin than the upper margin.

12. The bag of claim 10, further comprising a bottom panel proximate the lower margin of the shell and wherein the first portion of the strap is secured to the bottom panel.

13. The bag of claim 10, wherein the channel is defined between first and second stitch lines in the shell.

14. The bag of claim 10, wherein the upper margin of the shell and the second portion of the elongated strap define a loop length and wherein the second portion includes at least one means for shortening the loop length.

15. The bag according to claim 10, wherein said shell is formed of two plies of material, wherein said channel is formed by sewing said two plies together to thereby form said channel to receive said strap.

16. The bag according to claim 10, wherein the shell has an edge folded over onto itself and wherein the channel is formed by a row of stitches inside the folded over edge.

17. A vertically expandable bag, comprising:

a shell having a lower margin and an upper margin spaced from the lower margin by a predetermined vertical rise of material, the shell defining an interior space for receiving items;

a channel defined along the predetermined vertical rise of material of the shell;

an elongated strap having a first portion disposed within the channel and a second portion exposed from the channel and defining a carry strap for handling by a user; and a snap means having a first component disposed on at least one of the first and second portions of the strap and a second component disposed proximate the channel, the first and second components being matingly engageable to lock the upper margin of the shell in position relative to the second portion of the strap, wherein the channel cinches the material of the shell along the predetermined vertical rise thereof as the upper margin is slid along the first portion of the strap toward the lower margin of the shell while the second portion of the strap defining the carry strap increases in length, and wherein gathers in the shell are released and the predetermined vertical rise is at least partially restored as the upper margin is slid along the second portion of the elongated strap.

* * * * *